US005096664A

United States Patent [19]

Uehara et al.

[11] Patent Number: 5,096,664

[45] Date of Patent: Mar. 17, 1992

[54] ALLOYS HAVING EXCELLENT EROSION RESISTANCE AND STRESS CORROSION CRACKING RESISTANCE

[75] Inventors: Toshihiro Uehara, Yasugi; Rikizo Watanabe, Mooka, both of Japan

[73] Assignee: Agency of Industrial Science and Technology, Tokyo, Japan

[21] Appl. No.: 648,524

[22] Filed: Jan. 30, 1991

[30] Foreign Application Priority Data

Apr. 4, 1990 [JP] Japan ..... 2-88291

[51] Int. Cl.[5] ..... C22C 38/38

[52] U.S. Cl. ..... 420/74; 420/70; 420/56

[58] Field of Search ..... 420/74, 56, 70

[56] References Cited

FOREIGN PATENT DOCUMENTS 54-119320 9/1979 Japan ..... 420/74
54-130428 10/1979 Japan ..... 420/74
57-200543 12/1982 Japan ..... 420/74

*Primary Examiner*—Deborah Yee

*Attorney, Agent, or Firm*—Cushman, Darby & Cushman

[57] ABSTRACT

Alloys according to the present invention exhibit good resistance to erosion and stress corrosion cracking. The contents of individual components in these alloys as expressed in terms of wt. % are as follows:

$0.35 \leqq C \leqq 1.7$,
$Si \leqq 2.5$,
$10 \leqq Mn \leqq 25$,
$6 \leqq Cr \leqq 20$,
$0.5 \leqq V \leqq 7$,
$0.5 \leqq Nb \leqq 3$, and
$N \leqq 0.1$,
$Fe =$ balance.

Further, a mutual relationship represented by the following formula is maintained amoung the contents of V, Nb and C:

$$(V/5+Nb/8)/C \geqq 1.0$$

6 Claims, 1 Drawing Sheet

ALLOYS HAVING EXCELLENT EROSION RESISTANCE AND STRESS CORROSION CRACKING RESISTANCE

BACKGROUND OF THE INVENTION

1. Field of the Invention

The present invention relates to alloys which have excellent erosion resistance and stress corrosion cracking resistance and are suitable for use in apparatus, equipment, devices and parts susceptible to erosion due by a fluid, droplets and/or cavitation, such as erosion shields of steam turbines and valves, especially in application fields where erosion resistance and stress corrosion cracking resistance are both required.

2. Description of the Prior Art

Stellites, which are Co-Cr-W-C alloys excellent in erosion resistance, are now used in apparatus, devices, equipment and parts susceptible to erosion by a fluid, droplets, cavitation and/or the like, such as erosion shields for steam turbines and valve seats for piping, led by those employed in nuclear power plants. Stellites however have a high Co content and are hence costly. Moreover, when employed especially in nuclear power plants, Co is rendered radioactive, thereby posing the problem that people and other living creatures may be exposed to radiation.

To overcome these problems, the present inventor previously proposed, as Co-free alloys having excellent erosion resistance, the alloys disclosed in Japanese Patent Application Laid-Open Nos. 317652/1988 and 111844/1990. Describing the specific compositions of these alloys, the former are alloys consisting of 0.35-2.7% C, ≦2.5% Si, 10-25% Mn, 6-20% Cr, 0.5-11% V, ≦0.1% N, all by weight basis, and the balance being essentially Fe. They may additionally contain ≦3% Ni and/or ≦4% Mo. The latter are alloys having excellent erosion resistance and consisting of 0.9% <C ≦1.7%, ≦2.5% Si, 10-25% Mn, 6-20% Cr, 3.7-7% V, ≦0.1% N, and either one or both of ≦5% W and ≦3% Ti, and the balance being essentially Fe.

The alloys disclosed in Japanese Patent Application Laid-Open Nos. 317652/1988 and 111844/1990 are usually employed after applying solution treatment at 1,150° C. and then aging at 750° C. As a result of a detailed investigation on the above alloys by the present inventors, it has become clear that alloys subjected to aging at 750° C. are, despite of their excellent erosion resistance, insufficient in stress corrosion cracking resistance when employed in an environment tending to induce stress corrosion cracking, especially as an apparatus, device, equipment or part which is used to handle a salt-containing fluid.

It has however been found that the stress corrosion cracking resistance of these alloys can be improved without any reduction in erosion resistance when they are subjected to aging at a high temperature of 775-975° C. subsequent to their solution treatment at a conventional temperature. The above heat treatment however involves the problem that it cannot bring about sufficient effects when high stress greater than about 40 kgf/mm$^2$ is applied although improvements to stress corrosion cracking resistance are observed for stress less than about 40 kgf/mm$^2$.

SUMMARY OF THE INVENTION

An object of the present invention is to provide an alloy which does not contain Co, has excellent erosion resistance, and also has high stress corrosion cracking resistance even under high stress.

The present inventors conducted stress corrosion cracking tests on the above alloys in salt water and observed by a scanning electron microscope fracture surfaces of test pieces which underwent stress corrosion cracking. As a result, those fracture surfaces were found to present intergranular fracture. It was hence become clear that the stress corrosion cracking is of the intergranular fracture type. Microstructures were also observed, resulting in the confirmation of precipitation of chromium carbide continuously along grain boundaries. It was hence found that the stress corrosion cracking of those alloys was caused by intergranular corrosion. This intergranular corrosion was believed to take place in the following mechanism. C and Cr, which were contained in the form of a solid solution in the matrix, were caused to react with each other by heat treatment or by heat effect during welding, whereby chromium carbide continuously precipitated along grain boundaries. This resulted in the formation of regions containing Cr at a low concentration, said regions being called "Cr depleted zones", in the proximity of the grain boundaries. These Cr depleted zones were preferentially corroded, resulting in the formation of intergranular fracture. The present inventors therefore came to the conclusion that prevention of continuous precipitation of chromium carbide continuously along grain boundaries would be necessary to avoid stress corrosion cracking of the intergranular fracture type in those alloys.

The present inventors accordingly have conducted an extensive investigation with a view toward improving stress corrosion cracking resistance without lowering erosion resistance while using the principal elements of the above-described alloys as base components. As a result, it has been found for the first time that, for the suppression of precipitation of chromium carbide in the present alloy system, the addition of Nb to immobilize C in the solid solution as niobium carbide in grains is effective and can substantially improve stress corrosion cracking resistance, leading to the completion of the present invention.

In one aspect of the present invention, there is thus provided an alloy having excellent erosion resistance and stress corrosion cracking resistance, which has the following composition:

$$0.35 \leqq C \leqq 1.7,$$
$$Si \leqq 2.5,$$
$$10 \leqq Mn \leqq 25,$$
$$6 \leqq Cr \leqq 20,$$
$$0.5 \leqq V \leqq 7,$$
$$0.5 \leqq Nb \leqq 3, \text{ and}$$
$$N \leqq 0.1,$$

by weight basis percentage, and the balance being essentially Fe, and a mutual relationship represented by the following formula being maintained among the contents of V, Nb and C:

$$(V/5 + Nb/8)/C \geqq 1.0.$$

DETAILED DESCRIPTION OF THE INVENTION

Figure 1:
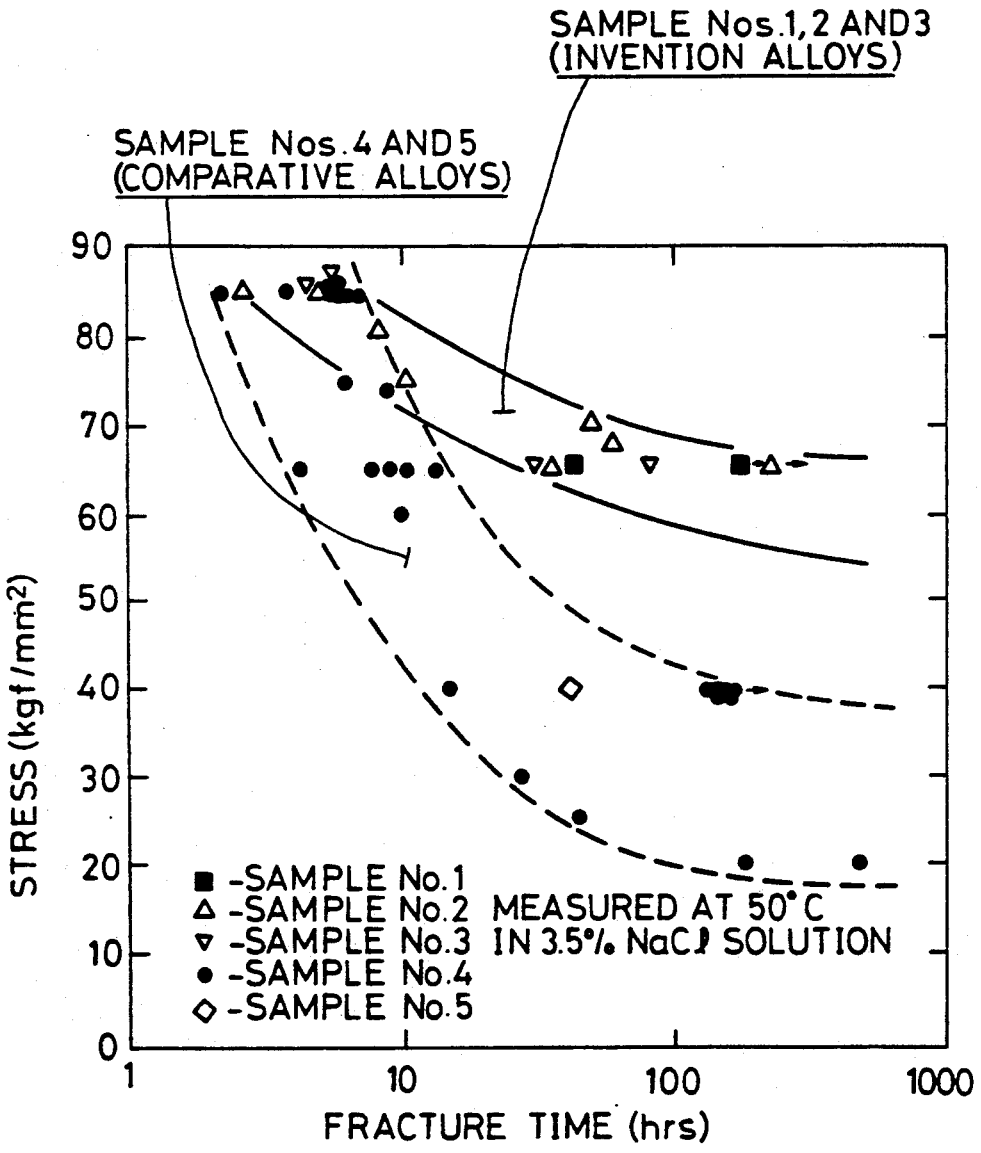
FIG. 1 diagrammatically illustrates the stress corrosion cracking resistance of alloys according to the present invention in comparison with that of comparative alloys.

A description will first be made of the functions of the individual elements and reasons for the numerical limitations to their contents in the present invention.

C is an element required not only to form the carbide of V and make crystal grains finer but also to improve the erosion resistance and strength by forming the carbide of V in a precipitation form through aging. Contents smaller than 0.35% however cannot form the carbide in an amount sufficient to bring about its effects fully. On the other hand, contents greater than 1.7% impair ductility and corrosion resistance. The content of C has therefore been limited to the range of 0.35–1.7%.

Si is an element also effective as a deoxidizer. No further improving effects are however expected even when Si is contained in amounts greater than 2.5%. The content of Si has accordingly been limited to the range not greater than 2.5%.

Mn is an element required to stabilize austenite of the face-centered cubic system and to absorb impact force of a liquid by inducing the martensite transformation to the $\epsilon$-phase of the close-packed hexagonal system upon application of the impact force, thereby improving the erosion resistance. Contents smaller than 10% lead to destabilization of austenite so that ferrite or martensite is formed before application of impact force. This results in transformation of a smaller amount of austenite to martensite when impact force is applied, whereby the erosion resistance is reduced. On the other hand, contents greater than 25% make austenite too stable. As a result, martensite transformation is rendered more difficult so that the erosion resistance is deteriorated. The content of Mn has therefore been limited to the range of 10–25%, with a range of 15–22% being more preferred.

Cr is an element required for the improvement of erosion resistance and corrosion resistance. Contents smaller than 6% however leads to a deterioration especially in corrosion resistance, while contents greater than 20% tend to induce the formation of ferrite or the $\sigma$ phase so that the erosion resistance is deteriorated. The content of Cr has hence been limited to 6–20%, with a range of 8–15% being more desired.

V is an element required to improve erosion resistance and strength by forming the carbide. Contents smaller than 0.5% are too low to draw out its effects fully. Contents in excess of 7% however lead to a reduction in ductility. The content of V has thus been limited to 0.5–7%, with a range of 1.8–5% being more desired.

Nb is an element capable of forming, along with V, the carbides of the MC type (M: V and/or Nb) primarily within grains prior to Cr. As a matter of fact, Nb forms the carbide prior to V. It is therefore possible to suppress the formation of the chromium carbide as a precipitation continuously along grain boundaries by making it sure to include carbon in an amount greater than that to be consumed for the formation of vanadium carbide effective for erosion resistance and immobilizing excess C, which is contained as solid solution in the matrix, as niobium carbide to reduce the content of C in the matrix. To allow Nb to exhibit the above effects, its content must be at least 0.5%. However, contents greater than 3% lead to deteriorated ductility and erosion resistance. The content of Nb has accordingly been limited to the range of 0.5–3%, with a range of 0.5–2.0% being more desired.

This invention also requires to control the value (V/5 + Nb/8)/C at 1.0 or greater, whereby the amount of solid solution C remaining after consumption for the formation of the above-described MC-type carbides is limited and the concentration of Cr in the matrix is increased to impart corrosion resistance. If the value (V/5 + Nb/8)C becomes smaller than 1.0, the concentration of C in the matrix increases, thereby making it easier to form chromium carbide. As a result, intergranular corrosion is accelerated. The value (V/5 + Nb/B)/C is therefore limited to a value not smaller than 1.0.

N is an element which tends to be mixed in as an impurity in high Mn-base alloys. Its forms the nitride with V. N therefore adversely affects the formation of vanadium carbide. In addition, solid solution N stabilizes austenite and makes martensite transformation difficult. N contents not higher than 0.1% however do not pose practical problem. The content of N has therefore been limited to the range not higher than 0.1%.

EXAMPLES

The present invention will hereinafter be described by the following examples.

Alloy Nos 1–6 of the chemical compositions shown in Table 1 were separately molten in a high-frequency induction furnace, whereby 10 kg ingots were produced. Among those alloys, Alloy Nos. 1–3 are invention alloys, Alloy Nos. 4–5 are comparative alloys free of Nb, and Alloy No. 6 is a comparative alloy with Nb added in an amount greater than the amount specified herein. These alloys were separately subjected to hot forging to produce bars of 30 mm square. Test pieces were obtained from those bars. Those test pieces were subjected to solid solution at 1,150° C., followed by water quenching. Thereafter, the test pieces were subjected to aging at 750–850° C., followed by air cooling. Cavitation erosion test and stress corrosion cracking test were then conducted on those alloys. Test conditions for the cavitation erosion test included 6.5 KHz vibrational frequency, 90 μm amplitude, 50° C. purified water as a test solution and 4 hours test time. Other conditions were set following the JSPS (the Japan Society for the Promotion of Science) method, i.e., the cavitation testing method of the magnetostrictive vibration type established in 1968 by the Cavitation Group at the 97th Corrosion Prevention Committee of the Japan Society for the Promotion of Science. On the other hand, the stress corrosion cracking test was conducted in a 3.5% salt water at 50° C. in accordance with the uniaxial constant-loading method, while using smoothed, rod-like test pieces having a diameter of 3 mm at their parallel parts. Corrosion resistance was evaluated in terms of the weight loss of each test piece after the test, while stress corrosion cracking resistance was evaluated in terms of the time [stress corrosion cracking (SCC) fracture time] until each test piece was fractured. The erosion resistance and stress corrosion cracking resistance of the invention alloys and comparative alloys are shown in Table 2 and FIG. 1, respectively.

As is apparent from Table 2 and FIG. 1, the invention alloys (Sample Nos. 1–3) had a small erosion weight loss and long stress corrosion cracking life (SSC fracture time) and hence exhibited good erosion resistance and stress corrosion cracking resistance. In contrast, the comparative alloys (Sample Nos. 4 and 5) had short stress corrosion cracking life as is shown in FIG. 1, and the comparative alloy (Sample No. 6) had a large erosion weight loss as indicated in Table 2. The comparative alloys (Sample Nos. 4–6) were therefore insufficient in stress corrosion cracking resistance and erosion resistance. As has been demonstrated by the above tests, it is understood that the invention alloys have both excellent erosion resistance and superb stress corrosion cracking resistance compared with the comparative alloys.

As has been described above, the alloys according to the present invention are free of Co, which is costly and involves the potential danger of radioactivation, and have both excellent erosion resistance and also has high stress corrosion cracking resistance. Their use in apparatus, devices, equipment and parts susceptible to damages by erosion and having potential problem of stress corrosion cracking, led by erosion shields for turbine blades and valves, can bring about marked industrial advantages such that the apparatus, devices, equipment and parts are rendered less susceptible to damages by erosion and also to stress corrosion cracking.

TABLE 1

| Sample No. | Chemical composition (wt. %) C | Si | Mn | Cr | V | Nb | N | Fe | $\frac{V/5 + Nb/8}{C}$ | Remarks |
|---|---|---|---|---|---|---|---|---|---|---|
| 1 | 0.94 | 0.31 | 18.20 | 9.98 | 4.14 | 1.51 | 0.049 | Balance | 1.08 | Invention alloy |
| 2 | 0.94 | 0.33 | 18.11 | 11.90 | 4.03 | 1.48 | 0.046 | Balance | 1.05 | Invention alloy |
| 3 | 0.94 | 0.31 | 18.02 | 11.71 | 4.02 | 2.80 | 0.049 | Balance | 1.23 | Invention alloy |
| 4 | 0.92 | 0.24 | 17.69 | 10.14 | 4.20 | — | 0.073 | Balance | 0.91 | Comparative alloy |
| 5 | 0.96 | 0.35 | 18.21 | 12.16 | 4.09 | — | 0.051 | Balance | 0.85 | Comparative alloy |
| 6 | 0.95 | 0.33 | 18.12 | 14.10 | 4.18 | 3.52 | 0.063 | Balance | 1.34 | Comparative alloy |

TABLE 2

| Sample No. | Erosion weight loss (mg) (after 4-hr test) | Remarks |
|---|---|---|
| 1 | 3.6 | Invention alloy |
| 2 | 3.7 | Invention alloy |
| 3 | 7.6 | Invention alloy |
| 4 | 3.4 | Comparative alloy |
| 5 | 3.7 | Comparative alloy |

TABLE 2-continued

| Sample No. | Erosion weight loss (mg) (after 4-hr test) | Remarks |
|---|---|---|
| 6 | 19.5 | Comparative alloy |

What is claimed is:

1. An alloy having excellent erosion resistance and stress corrosion cracking resistance, which has the following composition:

$$0.35 \leqq C \leqq 1.7,$$
$$Si \leqq 2.5,$$
$$10 \leqq Mn \leqq 25,$$
$$6 \leqq Cr \leqq 20,$$
$$0.5 \leqq V \leqq 7,$$
$$0.5 \leqq Nb \leqq 3, \text{ and}$$
$$N \leqq 0.1,$$

by weight basis percentage, and the balance being Fe, and a mutual relationship represented by the following formula being maintained among the contents of V, Nb and C:

$$(V/5 + Nb/8)/C \geqq 1.0.$$

2. The alloy of claim 1, wherein the content of Mn is $15 \leqq Mn \leqq 22$ by weight basis percentage.

3. The alloy of claim 1, wherein the content of Cr is $8 \leqq Cr \leqq 15$.

4. The alloy of claim 1, wherein the content of V is $1.8 \leqq V \leqq 5$.

5. The alloy of claim 1, wherein the alloy is free of Co except for Co as an inevitable impurity.

6. The alloy of claim 1, wherein the alloy is suitable for use in apparatus, devices and equipment and parts thereof, said apparatus, devices, equipment and parts being subjected to erosion by a fluid, droplets, cavitation and/or the like.

* * * * *